United States Patent [19]

Acimovic et al.

[11] 4,397,717

[45] Aug. 9, 1983

[54] ALKALINE ZINC ELECTROPLATING BATH WITH OR WITHOUT CYANIDE CONTENT

[75] Inventors: Simeon Acimovic; Karl-Heinz Lindemann; Volker G. Kunz, all of Trebur, Fed. Rep. of Germany

[73] Assignee: Elektro-Brite GmbH & Co. KG., Trebur, Fed. Rep. of Germany

[21] Appl. No.: 233,170

[22] Filed: Feb. 10, 1981

[51] Int. Cl.[3] ..... C25D 3/22; C25D 3/24

[52] U.S. Cl. ..... 204/55 Y; 204/55 R

[58] Field of Search ..... 204/55 R, 55 Y, 43 Z

[56] References Cited

U.S. PATENT DOCUMENTS

| | | | |
|---|---|---|---|
| 3,974,045 | 8/1976 | Takahashi et al. | 204/55 R |
| 4,045,306 | 8/1977 | Senge et al. | 204/55 R |
| 4,169,771 | 10/1979 | Creutz et al. | 204/55 R |
| 4,169,772 | 10/1979 | Lowery et al. | 204/55 R |
| 4,188,271 | 2/1980 | Eckles et al. | 204/55 R |

*Primary Examiner*—G. L. Kaplan

*Attorney, Agent, or Firm*—Wallenstein, Wagner, Hattis, Strampel & Aubel

[57] ABSTRACT

A bath for electoplating zinc containing in aqueous solution a zinc salt, an alkali metal hydroxide, optionally, an aromatic aldehyde or ketone and other usual additives and, if desired, an alkali metal cyanide and further, as a brightener, one or more reaction products obtained by reacting (a) an epihalohydrin with a heterocyclic nitrogen compound containing at least two reactive nitrogen atoms which compound may be substituted by 1 or 2 methyl, ethyl or amino groups or of a mixture of such reaction products of the epihalohydrin and the nitrogen compound in a molar ratio of 1:1 with (b) ammonia, an aliphatic amine, polyamine and/or polyimine in a molar ratio of 1:0.3 to 1:1 said bath yielding highly brilliant zinc coatings which may be up to 40 μm thick and are abrasion resistant and resistant to temperatures up to about 220° C. in a range of current densities of from 0.5 to 5 amps/dm$^2$.

4 Claims, No Drawings

ALKALINE ZINC ELECTROPLATING BATH WITH OR WITHOUT CYANIDE CONTENT

The invention relates to an alkaline zinc electroplating bath with or without cyanide for the electrodeposition of lustrous to highly brilliant zinc coatings onto steel or iron.

It is known to use in alkaline zinc baths less poisonous compounds as brighteners and means for easier zinc deposition in place of a part or of the whole amount of the strongly poisonous alkali cyanides. Such compounds are, inter alia, polymeric reaction products of an epihalohydrin with a heterocyclic compound containing one or more nitrogen atoms, such as imidazole, pyrazole, cyclic amines or piperazine which have been manufactured in the presence of hexamethylene tetramine and ammonia as disclosed in U.S. patent specification No. 3,974,045. Similar additives are disclosed in German patent publication No. 2,525,264 and further reaction products of alkylene polyamines with epihalohydrins for zinc electroplating baths are known from German patent specification No. 1,771,371.

Apart from the fact that such baths frequently still contain relatively small amounts of cyanide in addition in order to obtain coatings having the required gloss and throwing power and abrasion resistance it was found that, in particular, baths containing reaction products of epichlorohydrin with heterocyclic nitrogen compounds, such as imidazole, 1,2,4-triazole or derivates thereof result in coatings which form blisters and peel off when thicker than about 10 μm. The brittleness of the coatings is in particular of importance if zinc coated objects must further be annealed which comprises heating to 150° to about 180° C.

Furthermore baths containing such reaction products result in no or faulty electrodeposition of zinc at current densities below about 0.8 amps/dm$^2$.

It has been found that zinc deposits up to 40 μm thick which are highly brilliant and can be annealed may be obtained within a broad range of current densities of from 0.05 to 5 amps/dm$^2$ from an alkaline zinc electroplating bath with or without cyanide content wherein the bath contains a zinc salt, an alkaline compound, optionally other usual additives and, as a brightener, one or more reaction products of a nitrogen compound having at least 2 nitrogen atoms with an epihalohydrin, characterized in that it contains as the epihalohydrin-reaction product a compound which has been obtained by reacting (a) the reaction product of a heterocyclic nitrogen compound containing at least two reactive nitrogen atoms which compound may be substituted with 1 or 2 methyl, ethyl or amino groups, with epihalohydrin or of mixtures of such reaction products in a molar ratio of 1:1 with (b) ammonia, an aliphatic amine, polyamine and/or polyimine in a molar ratio of 1:0.3 to 1:1.

Preferably the reaction product (a) is one that has been obtained by reacting equimolar amounts of (a) one or more heterocyclic compounds of the group consisting of imidazole, pyrazole, 1,2,3- or 1,2,4-triazole, tetrazole, pyridazine, 1,2,3-oxadiazole, 1,2,4- or 1,3,4-thiadiazole and derivatives thereof having 1 or 2 substituents elected from the group consisting of methyl, ethyl, phenyl or amino groups with (b) epichlorohydrin and further reacting the reaction product from (a) and (b) with (c) ammonia, ethylene diamine, tetraethylene pentamine or polyethylenimine having a molecular weight above 150, in a molar ratio of from 1:0.3 to 1:1.

A particularly preferred epihalohydrin-reaction product is formed in accordance with the following equation:

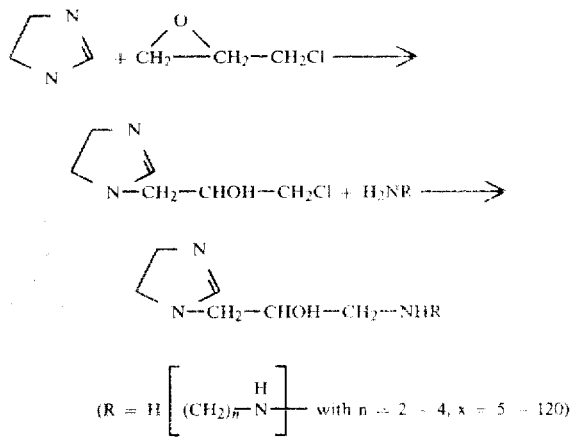

The zinc electroplating bath according to the invention contains the epihalohydrin-reaction product in amounts of from 0.1 to 20 g/liter, preferably 0.5 to 10 g/liter and especially preferred in amounts of from about 2.5 to 5 g/liter. Further additives which are usual as such which may be added to the electroplating bath of the invention are, besides the zinc compound which is usually zinc oxide dissolved in aqueous solution together with potassium or sodium hydroxide, are aldehydes and/or ketones, in particular aromatic aldehydes such as vanillin, anisaldehyde, veratrumaldehyde or benzaldehyde and optionally, sulfur compounds such as thiourea; polyvinylalcohol, polyvinylpyrrolidone and, if desired, other usual amino compounds such as known from the prior art. It has been found that, according to a preferred feature of the invention, an additional brightener in the form of a reaction product of (a) a polyvalent alcohol or of several polyvalent alcohols containing 1 to 5 carbon atoms for each oxygen atom with (b) epichlorohydrin or epibromohydrin and further reaction of the compound obtained with (c) a heterocyclic compound containing one or two nitrogen hetero-atoms which may be substituted by alkyl or alkoxy groups containing 1 to 3 carbon atoms, hydroxy groups or carboxy groups and salts thereof in a molar ratio 1:1 is used.

As the alcohol component (a) 1,4-butenediol, glycerol or pentaerythritol may be used. As heterocyclic compound (c) pyridine, the α-, β- or γ-methyl- and -ethyl-pyridines and the corresponding mono-, di- and tricarboxylic acids of pyridin and the methyl and ethylpyridines may be used.

Preferably this reaction product is 3-carboxylato-N-[γ-(1-hydroxy-butene-(2)-oxy)-(β-hydroxy)propyl]-pyridinium chloride in particular as Na-salt of the formula

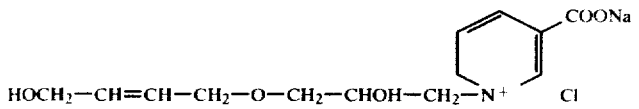

or benzylpyridinium-3-carboxylate. The aromatic aldehydes and ketones respectively and the other additives are used in an amount of from 0.05 to 10 g/liter, usually in the range of from 0.1 to 2 g/liter.

The zinc electroplating bath of the invention is particularly suited for depositing thick zinc layers onto iron or steel which are temperature resistant up to about 220° C. The bath is very stable and increases stability in a surprising manner by standing for a prolonged period. It is therefore very suited for the preparation of coatings of irregular configuration which tend to form thicker and thinner layers at the same object by the differences in current density. Current densities are in the range of from 0.05 to 5 amps/dm$^2$ but largely depend from the concentration of the bath consituents. These concentrations may be increased but result in lower current yields.

The invention is further illustrated by the following examples.

EXAMPLE 1

A zinc electroplating bath was made from the following constituents:

| | |
|---|---|
| zinc oxide | 10 g/liter Zn |
| sodium hydroxide | 80 g/liter |
| reaction product of equimolar amounts of imidazole with epichlorohydrin and subsequently with ethylene diamine in a molar ratio of from 1:0.5 to 1:0.6 | 0.2 g/liter |
| anisaldehyde | 0.2 g/liter |

Electrodeposition of zinc in a Hull cell at 1 amp/10 min resulted in a highly brilliant zinc coating onto steel sheet of 0.3 mm thickness in the whole current density range of from 0.05 to 5 amps/dm$^2$ with excellent distribution power in the depth.

EXAMPLE 2

The following zinc electroplating bath was prepared:

| | |
|---|---|
| zinc oxide | 30 g/liter Zn |
| NaCN | 85 g/liter |
| NaOH | 105 g/liter |
| reaction product of 1 mole of imidazole and 1 mole of epichlorohydrin and further with polyethylene imine (0.3-1 mole) | 0.6-1.0 g/liter |
| benzylpyridinium-3-carboxylate | 0.4 g/liter |
| anisaldehyde | 0.1 g/liter |

Electrodeposition of zinc onto steel sheet 0.3 mm thick in a Hull cell resulted in a highly brilliant Zn coating in the whole current density range of from 0.05 to 5 amps/dm$^2$ with excellent distribution power in the depth.

EXAMPLE 3

The following zinc electroplating bath was prepared:

| | |
|---|---|
| zinc oxide | 12 g/liter Zn |
| NaOH | 135 g/liter |
| reaction product of 1 mole of imidazole with 1 mole of epichlorohydrin and further with 0.5 to 1 mole of tetraethylene pentamine | 2 g/liter |
| anisaldehyde | 0.2 g/liter |
| benzylpyridinium-3-carboxylate | 0.2 g/liter |

Electrodeposition of zinc onto steel sheet 0.3 mm thick in a Hull cell at 1 amp/10 min resulted in a highly brilliant zinc coating in the whole current density range of from 0.05 to 5 amps/dm$^2$.

EXAMPLE 4

The following zinc electroplating bath was prepared:

| | |
|---|---|
| zinc oxide | 10 g/liter Zn |
| NaCN | 16 g/liter |
| NaOH | 80 g/liter |
| reaction product of imidazole-epichlorohydrin and ammonia (molar ratio 1:1) | 1.2 g/liter |
| 3-carboxylato-N—[γ-1-hydroxy-2-butene-4-oxo-(β-hydroxy)-propyl]pyridinium chloride (prepared from butenediol and epichlorohydrin in a molar ratio of 1:1 and further reaction with sodium nicotinate in a molar ratio of 1:1) | 0.2 g/liter |
| anisaldehyde | 0.2 g/liter |

Electrodeposition of zinc onto steel sheet 0.3 mm thick in a Hull cell at 1 amp/10 min resulted in highly brilliant zinc coating in the whole current density range of from 0.05 to 5 amps/dm$^2$ with excellent throwing power.

We claim:

1. Alkaline zinc electroplating aqueous bath containing a zinc salt, an alkali metal hydroxide, optionally other usual additives, and, if desired, an alkali metal cyanide and further one or more reaction products of an epihalohydrin with a nitrogen compound having at least 2 nitrogen atoms, characterized in that it contains as the epihalohydrin-reaction product a compound which has been obtained by reacting (a) the reaction product of a heterocyclic nitrogen compound containing at least two reactive nitrogen atoms which compound may be substituted with 1 or 2 methyl, ethyl or amino groups, with epihalohydrin in a molar ratio of 1:1 or of mixtures of such reaction products (in a molar of 1:1) with (b) ammonia, an aliphatic amine, polyamine and/or polyimine in a molar ratio of 1:0.3 to 1:1, said bath being further characterized in that it contains in addition the reaction product of a polyvalent alcohol or a mixture of polyvalent alcohols with epichlorohydrin or epibromohydrin in a molar ratio of 1:1, and further reacting the compound obtained with a heterocyclic compound having 1 or 2 nitrogen hetero-atoms which may be substituted by alkyl or alkoxy groups containing 1 to 3 carbon atoms, hydroxy or carboxy groups, or salts thereof in a molar ratio of 1:1.

2. Zinc electroplating bath as claimed in claim 1 characterized in that it contains in addition a compound of the formula

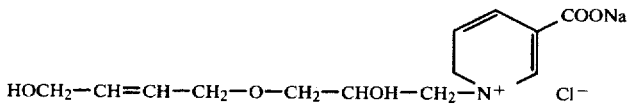

3. Zinc electroplating bath as claimed in claim 1, characterized in that it contains as the epihalohydrin-reaction product a compound which has been obtained by reacting equimolar amounts of (a) one or more heterocyclic compounds of the group consisting of imidazole, pyrazole, 1,2,3- or 1,2,4-triazole, tetrazole, pyridazine, pyrimidine, pyrazine, 1,2,3-oxadiazole, 1,2,4- or 1,3,4-thiadiazole, and derivatives thereof having 1 or 2 substituents elected from the group consisting of methyl, ethyl, phenyl or amino groups with (b) epichlorohydrin and further reacting the reaction product from (a) and (b) with (c) ammonia, ethylene diamine, tetrathylene pentamine or polyethyleneimine having a molecular weight above 150, in a molar ratio of from 1:0.3 to 1:1.

4. Zinc electroplating bath as claimed in claim 1, characterized in that it contains as the epihalohydrin-reaction product a compound which has been obtained by reacting (a) the reaction product of imidazole with epichlorohydrin in a molar ratio of 1:1 with (b) ammonia, ethylene diamine or tetraethylenepentamine.

* * * * *